US009945598B2

(12) United States Patent
Sherbeck et al.

(10) Patent No.: US 9,945,598 B2
(45) Date of Patent: Apr. 17, 2018

(54) SELF-DEMOLDING ICE MOLD AND METHODS OF USE AND AUTOMATION

(71) Applicants: Jonathan Sherbeck, Tempe, AZ (US); Nicholas Fette, Mesa, AZ (US)

(72) Inventors: Jonathan Sherbeck, Tempe, AZ (US); Nicholas Fette, Mesa, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 129 days.

(21) Appl. No.: 14/817,930

(22) Filed: Aug. 4, 2015

(65) Prior Publication Data

US 2016/0033186 A1 Feb. 4, 2016

Related U.S. Application Data

(60) Provisional application No. 62/032,873, filed on Aug. 4, 2014.

(51) Int. Cl.

| | |
|---|---|
| ***F25C 5/02*** | (2006.01) |
| ***F25C 1/04*** | (2018.01) |
| ***F25C 5/04*** | (2006.01) |

(52) U.S. Cl.

CPC ..... *F25C 1/04* (2013.01); *F25C 5/04* (2013.01); *F25C 2600/04* (2013.01)

(58) Field of Classification Search

CPC .... F25C 1/00; F25C 5/005; F25C 1/04; F25C 1/145

USPC ..... 62/66, 71, 73, 135, 347, 353, 449

See application file for complete search history.

(56) References Cited

U.S. PATENT DOCUMENTS

| | | | | |
|---|---|---|---|---|
| 2,024,517 A | | 12/1935 | Fowler | |
| 2,778,198 A | | 1/1957 | Heath | |
| 2,803,950 A | | 8/1957 | Bayston | |
| 2,939,298 A | | 6/1960 | Bauerlein | |
| 2,976,697 A | | 3/1961 | Dahl | |
| 3,024,618 A | | 3/1962 | Janquart | |
| 3,143,866 A | | 8/1964 | Frohbieter | |
| 3,144,078 A | | 8/1964 | Morton et al. | |
| 3,220,205 A | | 11/1965 | Breeding | |
| 3,300,998 A | * | 1/1967 | Jacobus | F25C 1/04 62/135 |
| 3,430,452 A | | 3/1969 | Dedricks et al. | |
| 3,620,497 A | | 11/1971 | Schaff | |
| 3,690,120 A | * | 9/1972 | Scheldorf | F25C 1/04 425/444 |

(Continued)

FOREIGN PATENT DOCUMENTS

EP 0131667 A2 1/1985

OTHER PUBLICATIONS

"Ice Cube Maker" downloaded from https://wiki.ece.cmu.edu/ddl/index.php/Ice_cube_maker on Nov. 2, 2015, page shows "last modified" date of Oct. 16, 2008.

*Primary Examiner* — Melvin Jones
(74) *Attorney, Agent, or Firm* — Snell & Wilmer L.L.P.

(57) ABSTRACT

Systems and methods for making ice utilize self-demolding ice molds. Responsive to freezing of water in the mold into ice, an ejection apparatus is compressed. Via a force arising from the compression, the ejection apparatus ejects the ice from the mold. Ice machines may utilize multiple molds, and water filling a first mold may be utilized to at least partially melt ice in a second mold to facilitate ejection of the ice from the second mold.

15 Claims, 10 Drawing Sheets

(56) References Cited

U.S. PATENT DOCUMENTS

| | | | | | |
|---|---|---|---|---|---|
| 4,059,970 | A | * | 11/1977 | Loeb | F25C 1/04 62/353 |
| 4,261,182 | A | * | 4/1981 | Elliott | F25C 1/04 62/353 |
| 4,487,024 | A | | 12/1984 | Fletcher et al. | |
| 4,817,911 | A | | 4/1989 | Infanti | |
| 4,852,359 | A | * | 8/1989 | Manzotti | F25C 1/10 62/353 |
| 4,923,494 | A | * | 5/1990 | Karlovits | F25C 5/08 62/351 |

* cited by examiner

SELF-DEMOLDING ICE MOLD AND METHODS OF USE AND AUTOMATION

CROSS-REFERENCE TO RELATED APPLICATIONS

This application claims priority to, and the benefit of, U.S. Provisional Patent Application Ser. No. 62/032,873 filed Aug. 4, 2014, entitled "SELF-DEMOLDING ICE MOLD AND METHODS OF USE AND AUTOMATION", which is hereby incorporated by reference in its entirety.

TECHNICAL FIELD

The present disclosure relates to ice makers, and in particular, to self-demolding and/or automatic ice makers.

BACKGROUND

Often, automatic ice makers include electric heaters to facilitate release of the ice. However, these electric heaters consume significant energy. Alternatives include manual ice makers; however, these ice makers require the ice to be manually released from the ice mold. Accordingly, improved ice makers, ice molds, and methods of use thereof remain desirable.

SUMMARY

In an exemplary embodiment, an ice formation apparatus is disclosed. The ice formation apparatus may include a mold configured with an ice cavity wherein water is freezable into an ice cube, and an ejection apparatus disposed within the ice cavity, the ejection apparatus configured to eject the ice cube from the ice cavity responsive to freezing of the water in the ice cavity.

In an exemplary embodiment, a self-demolding ice machine is disclosed. The self-demolding ice machine may include a first ice formation apparatus and a second ice formation apparatus disposed about a common axis of rotation. Each ice formation apparatus may include a mold configured with an ice cavity wherein water is frozen into an ice cube, and an ejection apparatus disposed within the ice cavity, whereby the ice cube is ejected from the ice cavity. The self-demolding ice machine may also include a filling apparatus having a water supply alternately conveyable to the first ice formation apparatus and the second ice formation apparatus, a sensing apparatus configured to sense that water has frozen in at least one of the first ice formation apparatus and the second ice formation apparatus, and an escapement disc having a circular member fixed about the common axis of rotation relative to which the first ice formation apparatus and the second ice formation apparatus are rotatable. The filling apparatus may be configured to selectably fill the first ice formation apparatus or second ice formation apparatus in response to rotating of the first ice formation apparatus and second ice formation apparatus relative to the escapement disc.

A method of making ice is disclosed. The method may include freezing, in an ice cavity of a mold having a compressible ejection element disposed within the ice cavity, water to form an ice cube, compressing, responsive to the freezing, the compressible ejection element, loosening the ice cube, and at least partially ejecting, by the compressible ejection element, the ice cube from the ice cavity.

The contents of this summary section are intended as a simplified introduction to the disclosure, and are not intended to be used to limit the scope of the appended claims.

BRIEF DESCRIPTION OF THE DRAWINGS

With reference to the following description, appended claims, and accompanying drawings as attached:

DETAILED DESCRIPTION

Figure 1:
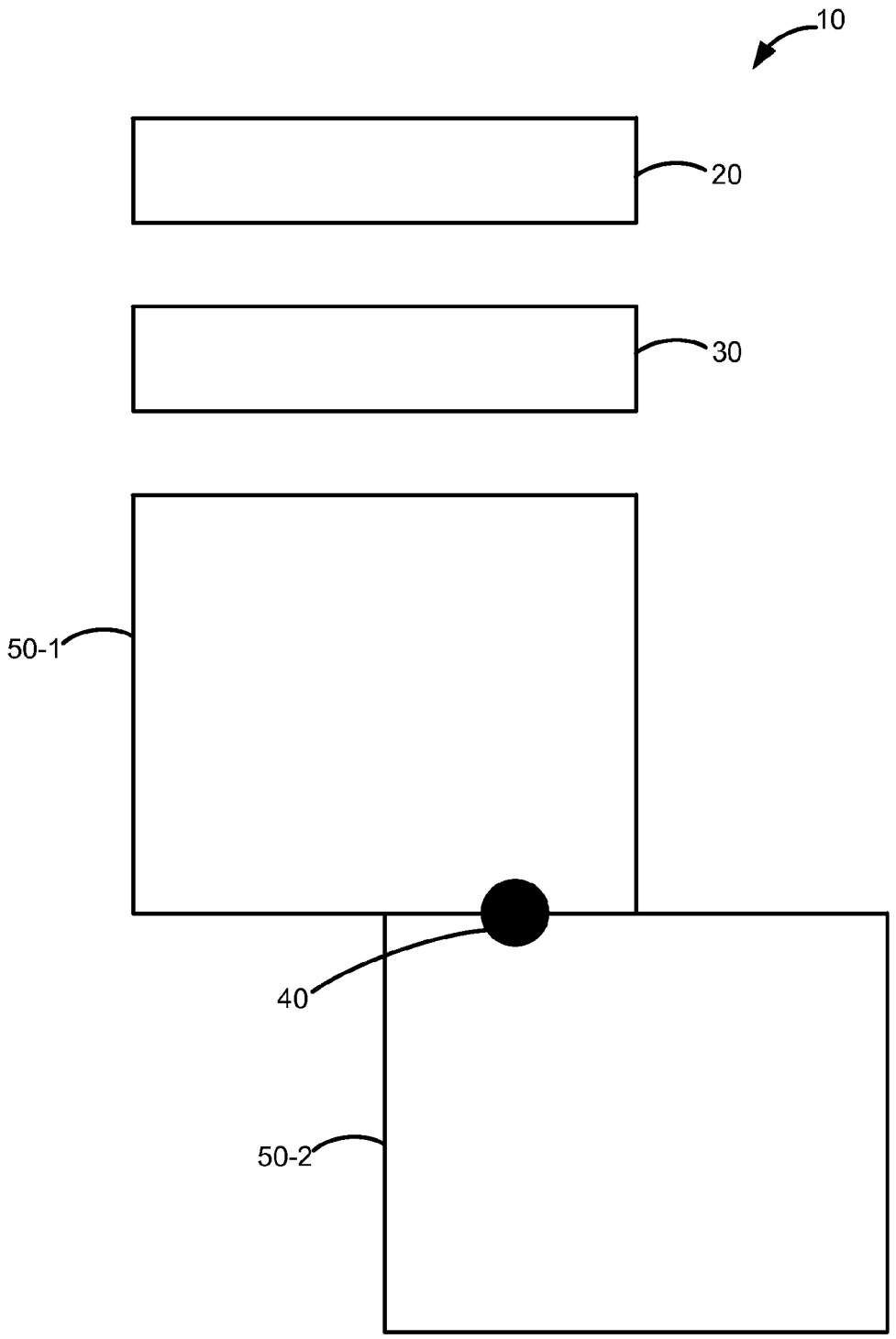
FIG. 1 illustrates a functional diagram of an exemplary automatic ice maker having two ice formation apparatuses in accordance with an exemplary embodiment.

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for ice cube formation, molding, mold ejection, manufacturing, and the like may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical method of construction.

Prior automatic ice making machines often utilize heat to release ice from a mold, increasing the total energy burden for producing the ice. Alternative, manual ice making machines may also require heat to release ice, and have the additional drawback of manual operation. In contrast, these and other drawbacks of conventional approaches can be overcome by utilizing self-ejecting/self-demolding molds in accordance with principles of the present disclosure. For example, self-ejecting ice molds can eliminate the need for application of heat to release ice from the mold.

Water expands about 9% when it freezes to form ice. This volumetric expansion causes ice to float in liquid water due to the lesser density of ice compared to water. Similarly, this volumetric expansion explains why only a tip of an iceberg emerges above the ocean. This volumetric expansion can generate tremendous pressure, such as to cause pipes to burst in cold weather.

Moreover, many domestic refrigerators and/or freezers in use today are frost free models. In these refrigerator/freezers, a fan blows air over an evaporator coil in the freezer so that the frost which does form is confined to the coil and is periodically removed by heating the evaporator coil to melt the frost, which then is drained out of the freezer.

Ice formed in a mold in such a freezer is primarily cooled by convection, evaporation, and/or sublimation from the surface of the water, the mold acting as an insulator. As such, if adhesion of the ice to the mold is great, as the water expands, the layer of ice may be broken and water may flow on top of the ice layer and build a convex layer of ice on top of the first layer(s) of ice. If the adhesion of the ice to the mold is not great relative to the strength of the ice layer, the first layers of ice may be lifted intact and an ice cube may form with a gap around the edges.

A controlled compressible element may be disposed in the mold so that the ice formed remains adhered to the mold until it reaches a desired ratio of frozen to unfrozen water, such as until it is nearly completely frozen and/or until it reaches a desired ratio of frozen to unfrozen water such as when the compressible element can no longer be compressed further. At such point a pressure is developed which causes the ice to be ejected from the mold. Further, this motion of the ice, alone or in combination with gravity, may cause the ice to eject and the mold to be properly queued for the making of more ice.

In various exemplary embodiments, with momentary reference to FIG. 1, an ice formation apparatus, for example ice formation apparatus 50, may be configured to at least partially eject ice from a mold by utilizing a force or forces arising from the state change of liquid water to solid ice.

In accordance with principles of the present disclosure, one or more ice formation apparatuses may be installed into a self-demolding ice machine. With reference now to FIG. 1B, in an exemplary embodiment an ice machine 10 may comprise a filling apparatus 20, a sensing apparatus 30, and one or more ice formation apparatus 50 disposed about an axis of rotation 40. In an exemplary embodiment, an ice machine 10 comprises a first ice formation apparatus 50-1 and a second ice formation apparatus 50-2. Any suitable number of ice formation apparatuses 50 may be utilized in an ice machine 10.

Figure 8:
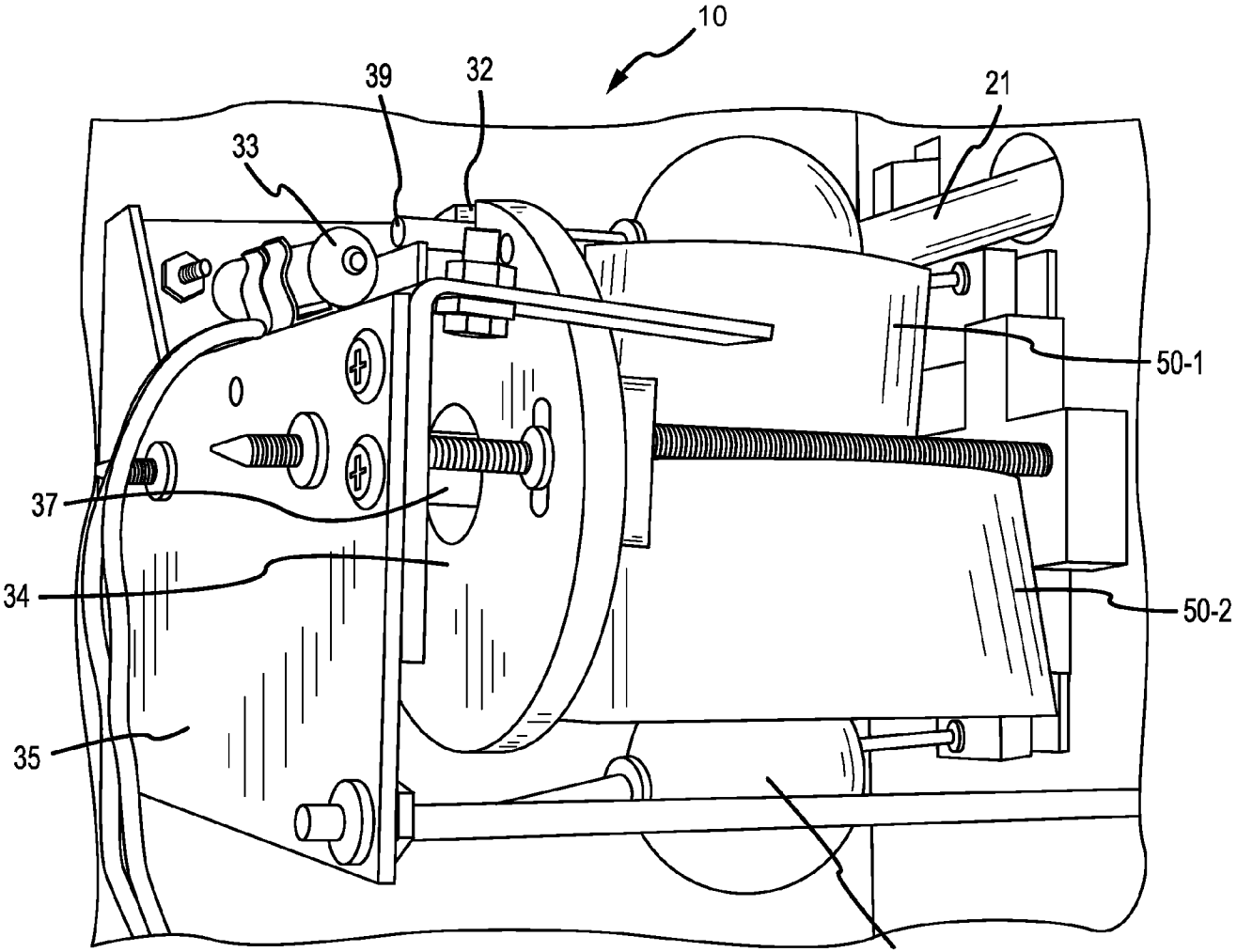
FIG. 8 illustrates an exemplary automatic ice maker having two ice formation apparatuses in accordance with an exemplary embodiment.

With reference now to FIGS. 1B and 8, in various exemplary embodiments, filling apparatus 20 may comprise a water supply 21. Water supply 21 may comprise a partial tube, a hose, a tube, or any other apparatus whereby water may be conveyed to and/or into an ice formation apparatus 50, such as a first ice formation apparatus 50-1 and a second ice formation apparatus 50-2.

In certain exemplary embodiments, axis of rotation 40 is achieved via a shaft 37 sharing an axis with the fixed escapement disc 34, or other suitable component configured to vary the vertical orientation of one or more ice formation apparatus 50. Escapement disc 34 may be a circular member rotationally fixed to frame 35 and disposed about an axis of rotation 40 of a first ice formation apparatus 50-1 and a second ice formation apparatus 50-2. The two ice formation apparatus 50 may be joined together, each facing in different directions, for instance, opposite directions. In this manner, as two ice formation apparatuses 50 rotate about the axis, the different ice formation apparatus 50 come to be oriented for filling with water and subsequent freezing, for instance, vertically oriented relative to the direction of gravity and with respect to the fixed escapement disc 34 (and thus the disc slot 32 disposed therein). In this manner, the two ice formation apparatuses 50 may be selectively anti-rotated (e.g., selectively rotationally fixed) by the escapement disc 34.

In various exemplary embodiments, sensing apparatus 30 comprises any suitable apparatus configured to sense the level of water in ice formation apparatus 50 and/or whether the water is frozen (or partially frozen) in ice formation apparatus 50. In certain exemplary embodiments, sensing apparatus 30 comprises a float valve 31, an escapement disc slot 32 disposed at least partially radially (or otherwise) through escapement disc 34, and a switch 33. Float valve 31 may comprise a buoyant ball coated with silicone to make it hydrophobic. Alternatively, float valve 31 may comprise any device configured to be less dense than liquid water, so that it floats. Moreover, float valve 31 may have any coating or material composition to render it hydrophobic, for example, so that as the water freezes, float valve 31 rests on top of the ice rather than being frozen into the ice. Switch 33 may be connected in mechanical communication with float valve 31. Switch 33 assesses the position of float valve 31 so as to ascertain whether the water has completed the filling process. In various embodiments, switch 33 is a mercury switch, though any suitable switch or sensor (for example, an optical sensor) rather than a switch 33 and a float valve 31 may be used. Moreover, float valve 31 may be connected to a switch 33 by a shaft 39 which travels through an escapement disc slot 32. In this manner, the ice formation apparatus is prevented from unwanted movement relative to the escapement disc 34 unless float valve 31 is raised sufficiently high by the frozen water to indicate that the water has frozen and the ice cube is ready for dumping, for example into a hopper. In various exemplary embodiments, a separate float valve 31 is associated with each ice formation apparatus 50-1, 50-2.

With reference again to FIGS. 1 through 4, an ice formation apparatus 50 may comprise a structure forming any cavity, or series of cavities, into which water may be filled and frozen into ice. For example, an ice formation apparatus 50 may resemble an ice tray to form multiple cubes of ice. Alternatively, an ice formation apparatus 50 may have a single cavity to form a single cube of ice.

Figure 2:
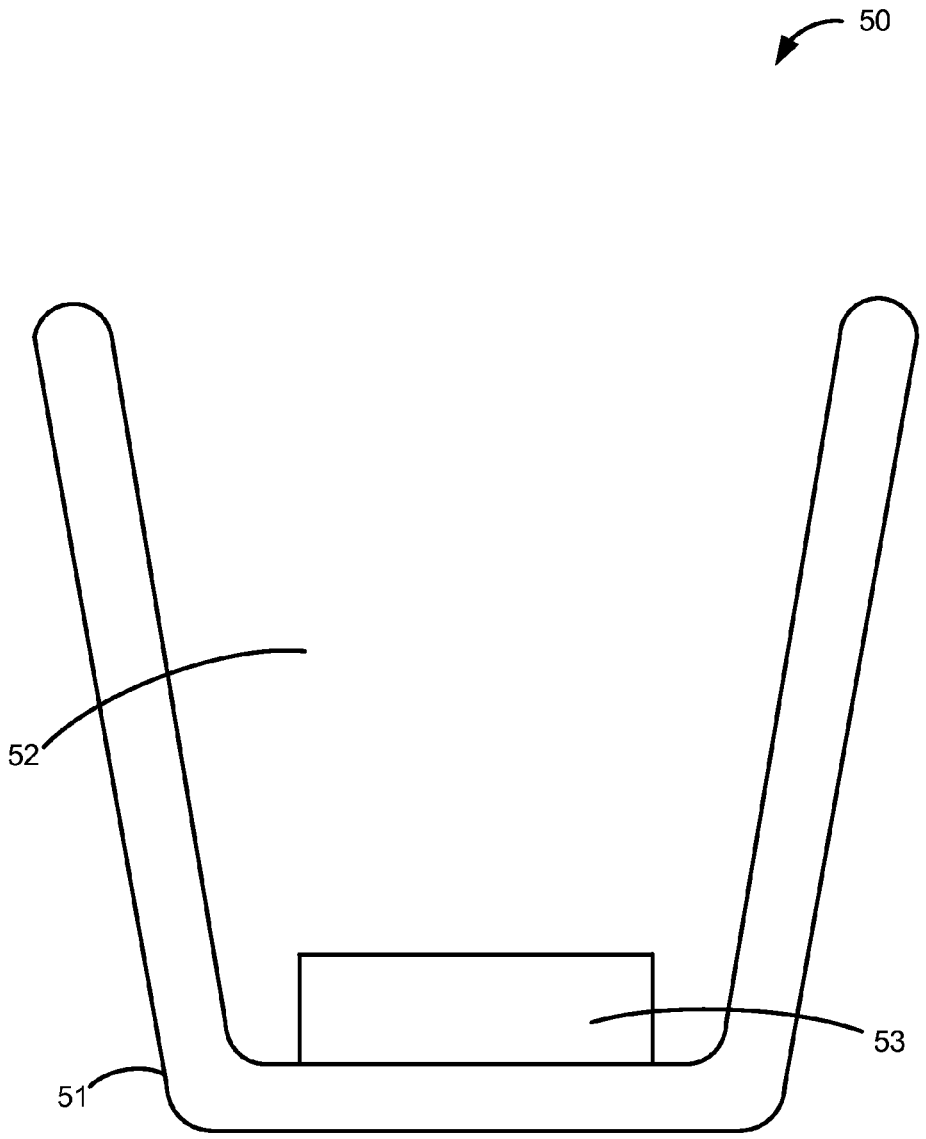
FIG. 2 illustrates a functional diagram of an ice formation apparatus in accordance with an exemplary embodiment.

With reference now to FIG. 2, in various exemplary embodiments ice formation apparatus 50 comprises a mold 51 defining an ice cavity 52, and an ejection apparatus 53. Mold 51 may comprise a shaped solid having a void disposed in one face wherein water may be filled and frozen. For example, mold 51 may comprise any shape or orientation, whereby the ice cavity 52 may be supported.

In various exemplary embodiments, ice cavity 52 comprises an orifice within the mold 51 shaped to conform to a desired outline of the ice to be formed. For example, ice cavity 52 may be cube shaped. In various exemplary embodiments, ice cavity 52 is configured with a trapezoidal profile with tapered walls so that the bottom of ice cavity 52 is "narrower" (e.g., a planar cross-section has less area) than the top of ice cavity 52. However, ice cavity 52 may comprise any shape adapted to permit the ice to eject from ice cavity 52 as desired. In various exemplary embodiments, ice cavity 52 is shaped to direct a force exerted by the water as it freezes into ice to at least partially compress ejection apparatus 53.

In various exemplary embodiments, ice cavity 52 and/or mold 51 may be shaped with at least partial consideration of the pressure created by the forming ice. Moreover, the material from which mold 51 is made may be selected with consideration of the pressure created by the forming ice. Mold 51 may be configured with a suitable thickness and/or selection of materials, and/or formed by a suitable manufacturing method selected with consideration of the pressure created by the forming ice. Additionally, mold 51 may comprise reinforcement structures, such as ribs, ridges, and other structures whereby the deformation of mold 51 may be constrained. For example, the pressure created by the forming ice may exert a force, such as a deforming force, on mold 51, and mold 51 may be configured to respond to or endure the deforming force without excessive and/or unwanted deformation.

In various exemplary embodiments, ejection apparatus 53 is configured to at least partially eject frozen ice from mold 51 responsive to the expansion of water in mold 51 as it freezes. In various exemplary embodiments, ejection apparatus 53 comprises a pressure exerting member disposed in the bottom of ice cavity 52. Ejection apparatus 53 operates to exert a force on an ice cube that has been formed in ice cavity 52 and push it at least partially from ice cavity 52, thus at least partially liberating it from mold 51. In various exemplary embodiments, ejection apparatus 53 comprises a spring, or a compressible material, or any other suitable mechanism whereby a force may be exerted. For example, in further exemplary embodiments, ejection apparatus 53 comprises an air pocket. In various exemplary embodiments, ejection apparatus 53 is compressed by the freezing ice as the water turns into ice, and thus elastic energy is stored in ejection apparatus 53 in response to force exerted as the water expands upon freezing.

In an exemplary embodiment, ejection apparatus 53 occupies approximately 9% of the volume of ice cavity 52 and/or may be approximately 9% compressible during the freezing process, corresponding to the approximately 9% volumetric expansion of water as it turns into ice. In other exemplary embodiments, ejection apparatus 53 may occupy between about 8% and about 10% of the volume of ice cavity 52 and/or may be between about 8% and 10% compressible during the freezing process. Moreover, in an exemplary embodiment, ejection apparatus 53 occupies approximately 7% of the volume of ice cavity 52 and/or may be approximately 7% compressible during the freezing process, corresponding to less than the approximately 9% volumetric expansion of water as it turns into ice, such as to further encourage liberation of the ice from the ice cavity 52, particularly in response to the further 2% volumetric expansion of the water following the full compression of the ejection apparatus 53. In other exemplary embodiments, ejection apparatus 53 may occupy between about 6% and about 8% of the volume of ice cavity 52 and/or may be between about 6% and 8% compressible during the freezing process. Moreover, any size ejection apparatus 53 adapted to effectuate at least partial liberation of the ice from ice cavity 52 may be implemented.

In various exemplary embodiments, ejection apparatus 53 is tailored so that the force exerted by ejection apparatus 53 on the ice cube (the "demolding force") may be tailored to at least partially liberate the ice cube from ice cavity 52 as the formation of the ice cube completes or nears completion. For example, the ratio of the compression of ejection apparatus 53 as the ice freezes to the demolding force exerted by the ejection apparatus 53 in response to the displacement may also be tailored. For example, the ratio may be linear. Alternatively, the ratio may be asymptotic, approaching a limit as ejection apparatus 53 approaches a full compression. Moreover, the ratio may follow any suitable function, for example, any linear and/or non-linear, and/or step-wise function.

In various exemplary embodiments, ice formation apparatus 50 may be inverted when ice formation is complete. For example, with momentary additional reference to FIGS. 1B and 8, in response to the lifting of float valve 31, the shaft 39 of float valve 31 may rise out of escapement disc slot 32 and permit ice formation apparatus 50 to rotate about its axis relative to the escapement disc 34, for example, in response to gravity, or in response to an actuator, such as a motor, thus inverting ice formation apparatus 50. The combination of gravity and the force exerted by ejection apparatus 53 may expel the ice cube from ice formation apparatus 50, for example into a storage hopper.

In various exemplary embodiments, ejection apparatus 53 separates the ice cube from ice cavity 52 prior to the inverting, for example, due to the force stored in ejection apparatus 53 overcoming the static friction between the mold 51 and the ice, i.e., at or near the conclusion of the ice formation process.

Figure 3:
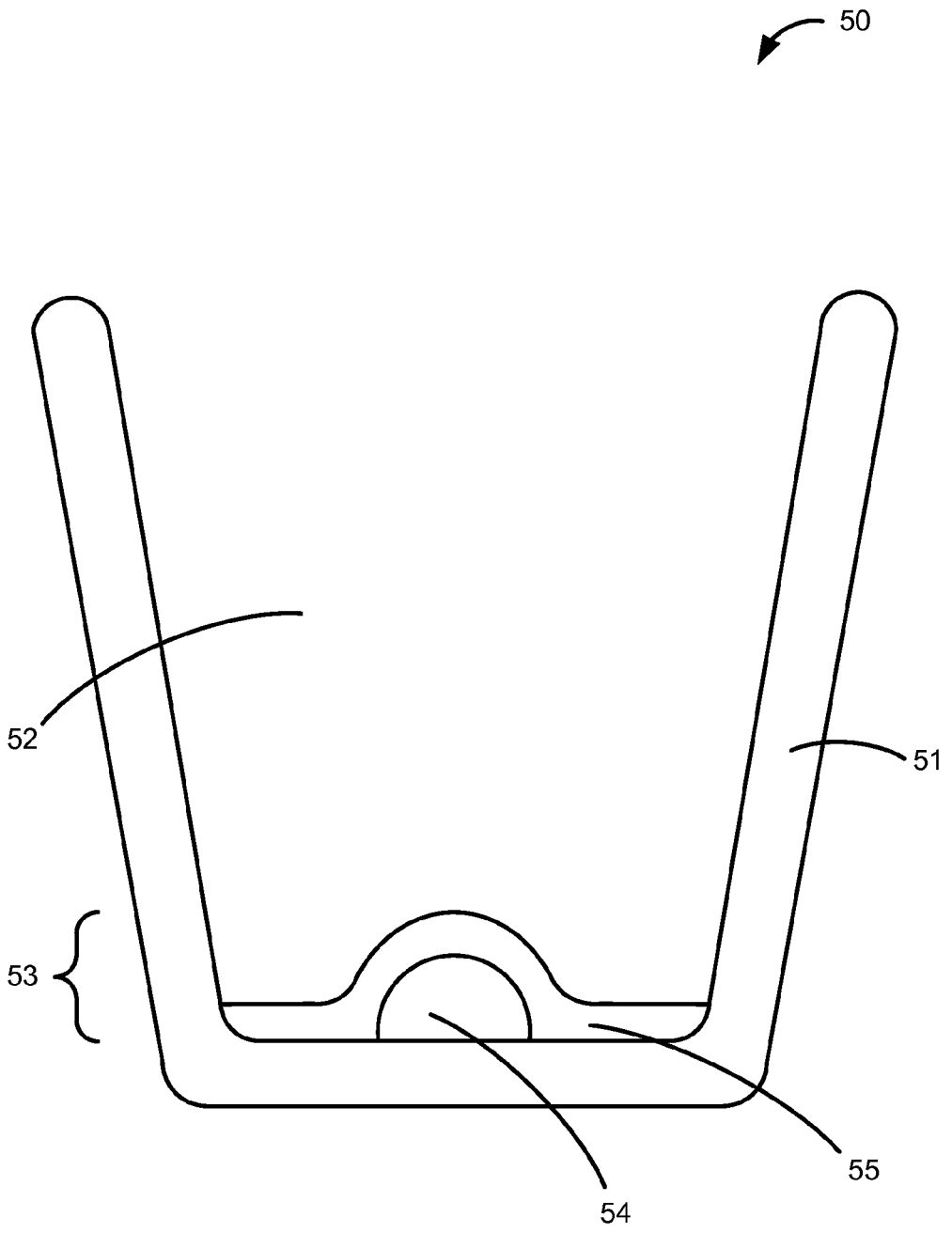
FIGS. 3-4 illustrate cutaway views of various exemplary ice formation apparatuses in accordance with various exemplary embodiments.
Figure 5:
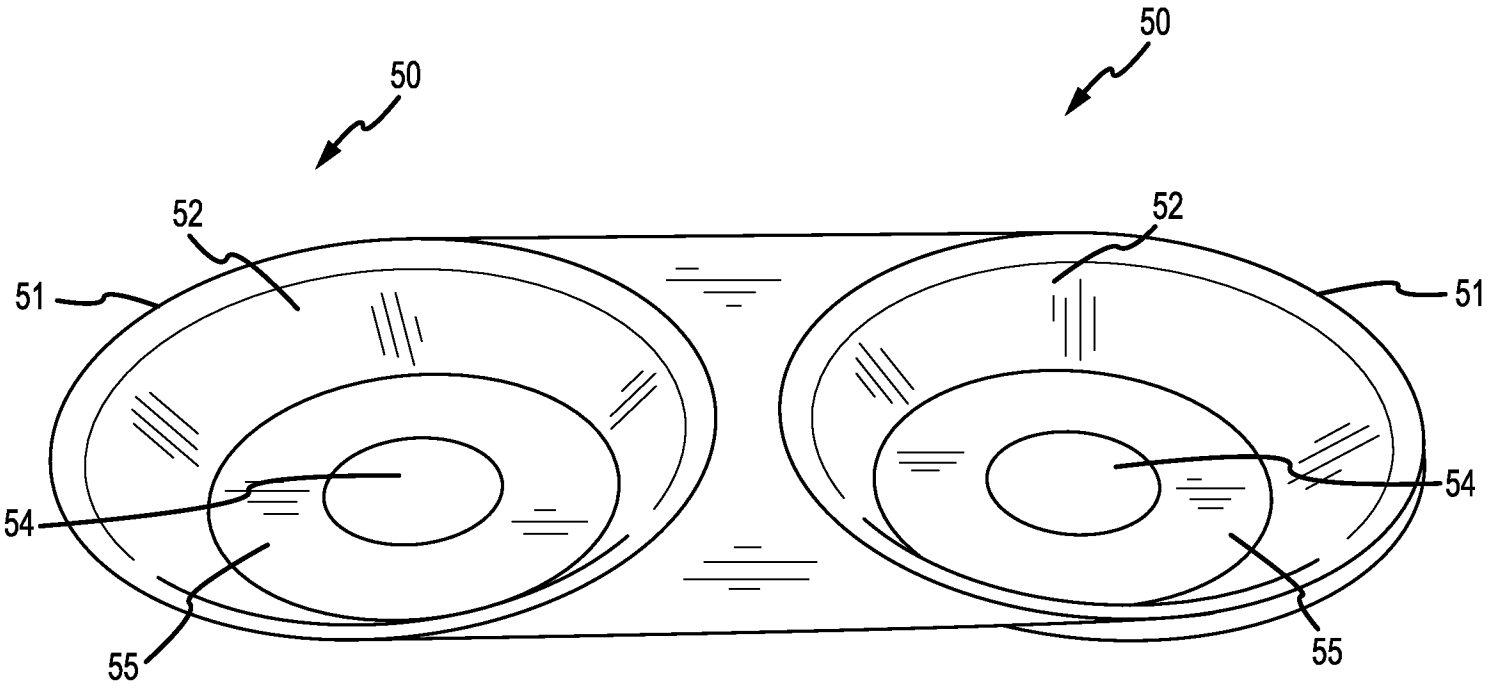
FIGS. 5-6 illustrate detailed views of exemplary ice formation apparatuses according to FIG. 3.
Figure 6:
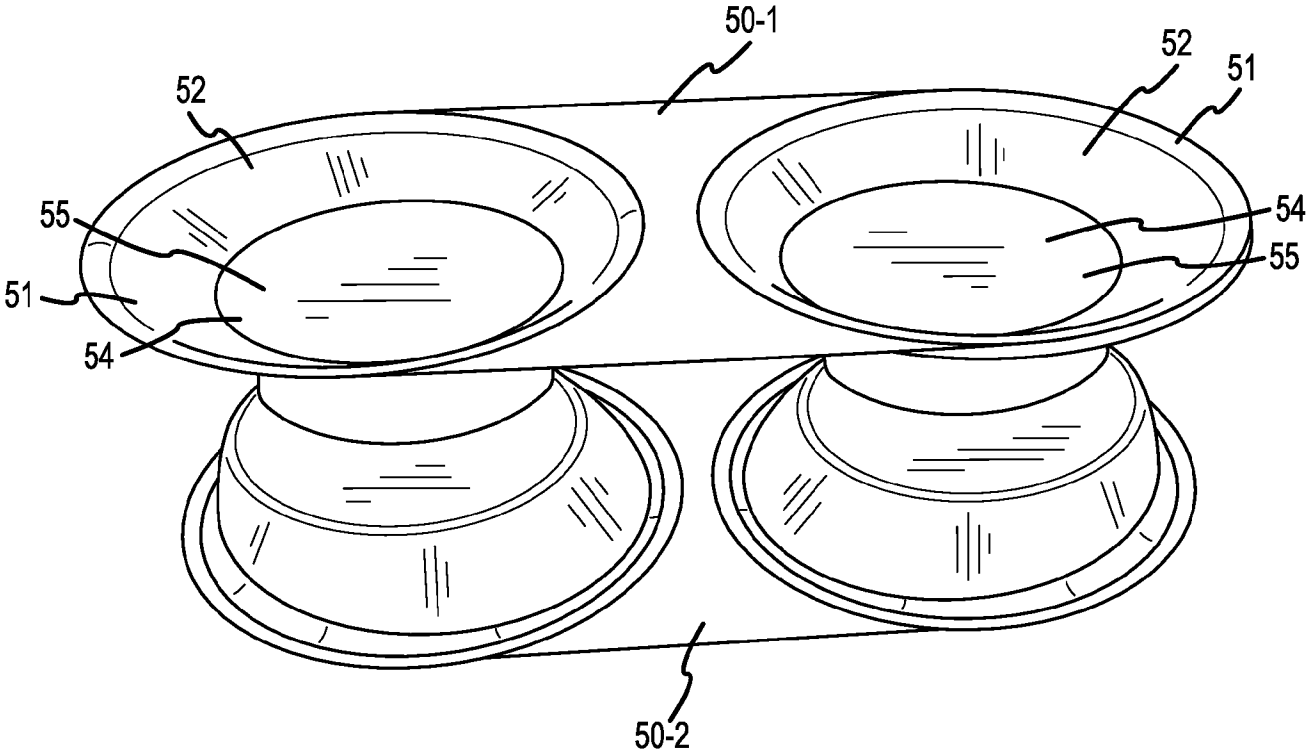

With reference now to FIGS. 3, 5, and 6, in certain exemplary embodiments, ejection apparatus 53 may comprise a compressible ejection element 54 and a flexible smoothing element 55. Compressible ejection element 54 may be disposed at a suitable location, for example in the bottom of ice cavity 52. Flexible smoothing element 55 may extend over the top of compressible ejection element 54, and may thus prevent the water/ice from directly contacting compressible ejection element 54. In various exemplary embodiments, flexible smoothing element 55 ameliorates sticking of the ice to compressible ejection element 54.

In an exemplary embodiment, compressible ejection element 54 comprises rubber. For example, with particular reference to FIG. 5, compressible ejection element 54 may comprise a compressible rubber and/or rubber foam. Alternatively, with particular reference to FIG. 6, compressible ejection element 54 may comprise silicone and/or silicone foam. Moreover, compressible ejection element 54 may comprise any material configured to compress as the water freezes into ice, and consequently to exert an ejecting force on the ice to at least partially separate the ice from mold 51.

In certain exemplary embodiments, flexible smoothing element 55 may comprise a layer of silicone disposed between compressible ejection element 54 and the interior of ice cavity 52 occupied by the water/ice. Flexible smoothing element 55 may also comprise a coating of compressible ejection element 54. Moreover, flexible smoothing element 55 may comprise a hydrophobic material. In various exemplary embodiments, flexible smoothing element 55 may comprise a cloth and/or fabric material. For example, flexible smoothing element 55 may comprise polyurethane-polyurea copolymer, for example elastane, and/or plastic, elastic, rubber, synthetic materials, natural materials, and/or blended materials, and/or combinations of the same.

In various exemplary embodiments, different elements or portions of ejection apparatus 53 may be configured with materials and/or structures having differing compressibility. For example, flexible smoothing element 55 may be less compressible than compressible ejection element 54. In various exemplary embodiments, flexible smoothing element 55 is non-compressible or minimally compressible. Moreover, compressible ejection element 54 may comprise multiple materials each having different compressibility. In this manner, the ratio of the compression of ejection apparatus 53 as the ice freezes to the demolding force exerted by ejection apparatus 53 in response to the displacement may be tailored, as desired, for example to follow a non-linear function. This may be desirable to exert a demolding force sufficiently strong to eject the ice cube from mold 51 only when the water in mold 51 has reached a suitable level of freezing, rather than when the water is only partially frozen.

Figure 4:
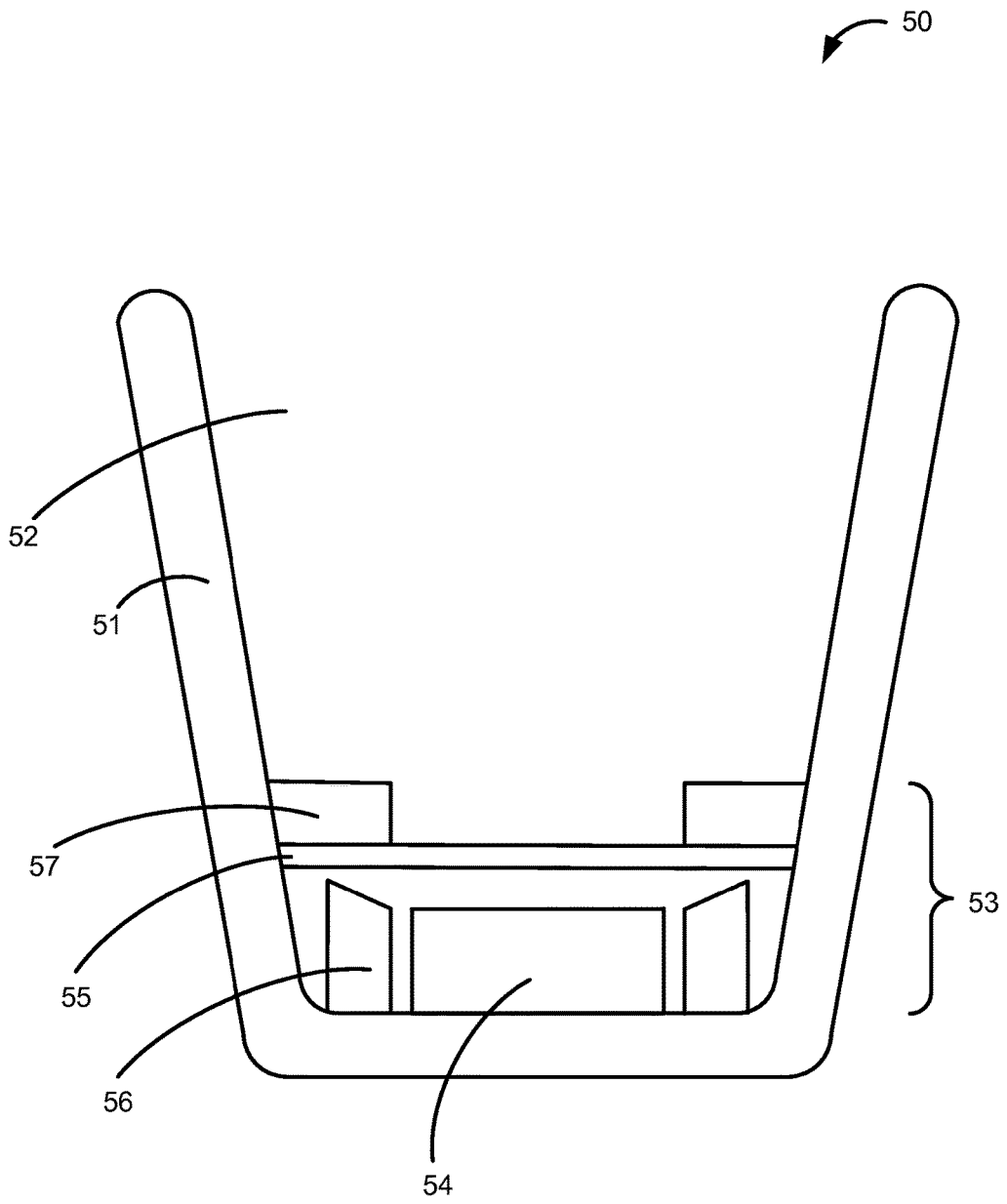
Figure 7:
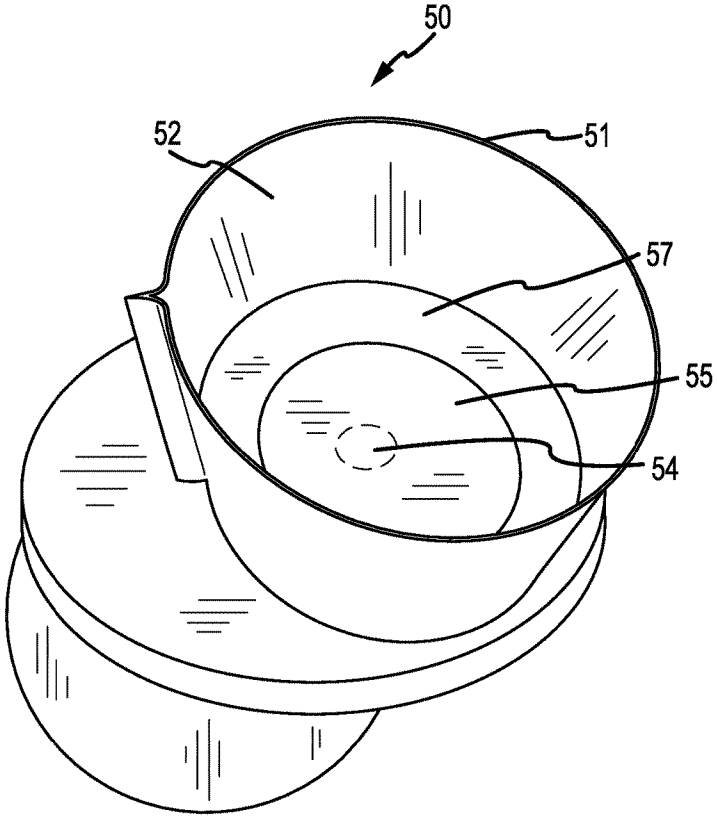
FIG. 7 illustrates a detailed view of an exemplary ice formation apparatus according to FIG. 4.

Turning now to FIGS. 4 and 7, in various exemplary embodiments ice formation apparatus 50 may comprise an ejection apparatus 53 comprising a compressible ejection element 54 and a flexible smoothing element 55. Additionally, ejection apparatus 53 may further include a shaping element 56 and a retention element 57.

In an exemplary embodiment, shaping element 56 may comprise an element disposed annularly outward of compressible ejection element 54 and positioned in the bottom of ice cavity 52. For example, shaping element 56 may comprise a circular washer having an angled face. Alternatively, shaping element 56 may comprise any feature configured to direct the ice toward contact with compressible ejection element 54 during freezing and/or ejection. For example, shaping element 56 may comprise a circular washer having an angled face configured with an angle of about 30 degrees below a plane parallel to the bottom of ice cavity 52. In this manner, shaping element 56 may extend a greater distance into ice cavity 52 at its annularly outward edge and a lesser distance into ice cavity 52 at its annularly inward edge, relative to its annularly outward edge.

In some exemplary embodiments, retention element 57 may be disposed within ice cavity 52 to retain the various other components of ejection apparatus 53 in position within ice cavity 52. For example, other components may include a compressible ejection element 54 that may be positioned in the bottom of ice cavity 52 and annularly inward of a shaping element 56. Other components may include a flexible smoothing element 55 disposed on top of compressible ejection element 54 and/or shaping element 56 and in direct contact with the ice/water within ice cavity 52. Accordingly, retention element 57 may be disposed on top of these other elements, for example, on top of flexible smoothing element 55. Retention element 57 may retain flexible smoothing element 55 and other elements in position within ice cavity 52. In various exemplary embodiments, retention element 57 comprises a washer. For example, retention element 57 may comprise a flat washer disposed about the inner perimeter of ice cavity 52 and in mechanical communication with ice cavity 52 and flexible smoothing element 55.

In some exemplary embodiments, a warming apparatus may be utilized in connection with self-demolding ice molds and systems as disclosed herein. It will be appreciated that when a warming apparatus is utilized in connection with principles of the present disclosure, a smaller of amount of heating is needed to release ice from an exemplary self-demolding ice mold as compared to a conventional mold, thus saving electricity.

Figure 9:
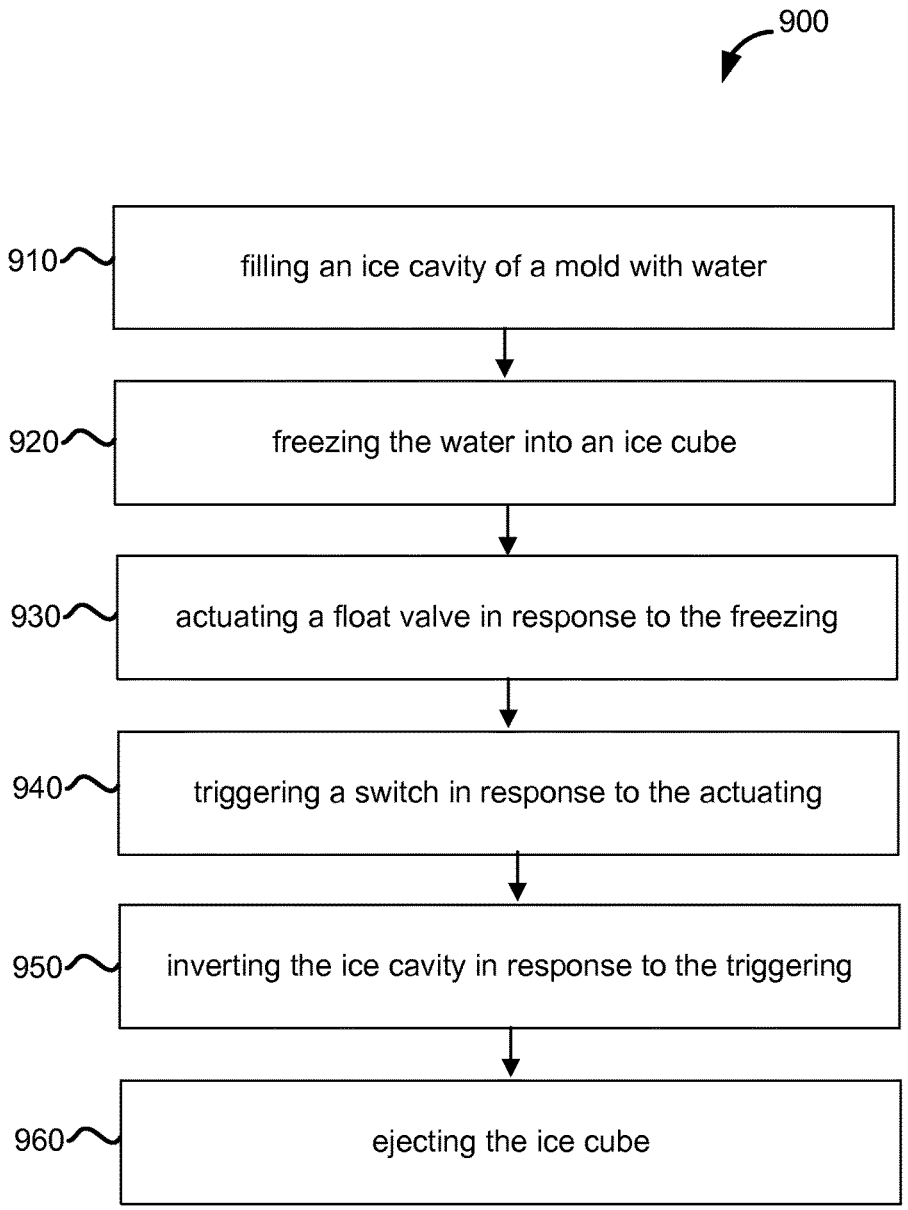
FIG. 9 illustrates an exemplary method of making ice in accordance with various exemplary embodiments.
Figure 10:
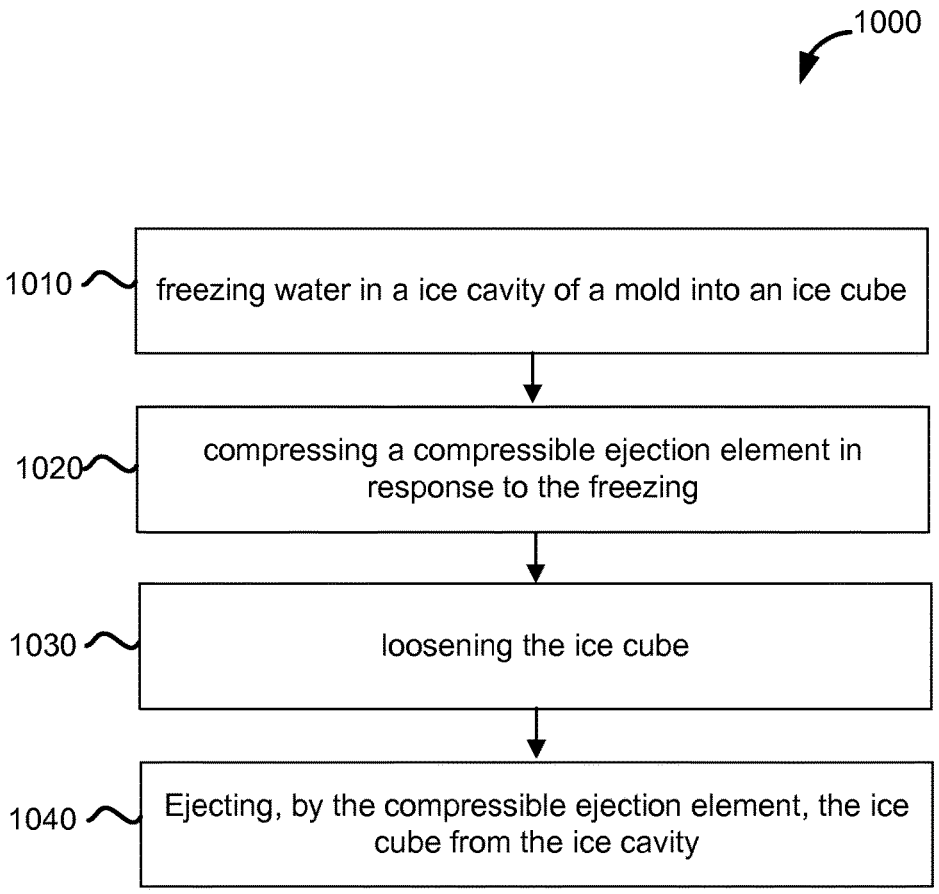
FIG. 10 illustrates an exemplary method of making ice in accordance with various exemplary embodiments.

In various exemplary embodiments, a warming apparatus may be disposed in thermodynamic communication with mold 51. For example, a warming apparatus may aid the release of the ice from mold 51 by melting a portion of the ice. With momentary reference to FIGS. 7-9, in various exemplary embodiments, the warming apparatus comprises a second ice formation apparatus 50-2 in thermodynamic contact with a first ice formation apparatus 50-1. In an exemplary embodiment, second ice formation apparatus 50-2 is filled with water in preparation for freezing as formed ice is sought to be ejected from first ice formation apparatus 50-1. Because the water entering second ice formation apparatus 50-2 is relatively warmer than the ice sought to be ejected from mold 51 of first ice formation apparatus 50-1, mold 51 may warm as heat is conducted from second ice formation apparatus 50-2 to mold 51. The warming apparatus of first ice formation apparatus 50-1 may likewise comprise second ice formation apparatus 50-2 and the warming apparatus of second ice formation apparatus 50-2 may comprise first ice formation apparatus 50-1. In further exemplary embodiments, an electrical heating element, or another warming apparatus may optionally be implemented.

In various exemplary embodiments, ice may be formed via operation of an exemplary ice machine 10 as disclosed herein. For example, with reference now to FIGS. 1 through 9, an exemplary method for making ice 900 comprises at least partially filling an ice cavity 52 of a mold 51 of a first ice formation apparatus 50-1 with water (step 910). The water is frozen into an ice cube (step 920). In response, a float valve 31 is actuated (step 930). The actuating triggers a switch 33 (step 940). For example, an electrical switch may activate a motor, or the triggering a switch 33 may comprise releasing a mechanical lock. Subsequently, ice cavity 52 of mold 51 of first ice formation apparatus 50-1 is inverted, for instance by a motor, or by gravity, or by a spring, or by any other suitable means, in response to the triggering (step 950). The ice cube is ejected in response to the inverting (step 960). In various exemplary embodiments, the ice cube is ejected by ejection apparatus 53.

With reference now to FIGS. 1 through 8 and FIG. 10, an exemplary method for making ice 1000 comprises freezing water in an ice cavity 52 of a mold 51 of an ice formation apparatus 50 to form an ice cube (step 1010). As the water freezes, the water compresses a compressible ejection element 54 of an ejection apparatus 53 (step 1020). Compressible ejection element 54 subsequently at least partially ejects the ice cube from ice cavity 52 of mold 51 (step 1040). A loosening step 1030 may be interposed between the compressing step 1020 and the ejecting step 1040. Loosening step 1030 may comprise melting a portion of the ice cube (for example, via activation of a heating element, via filling a mold 51 that is thermally coupled to the first mold 51 with unfrozen water, and/or the like). Loosening step 1030 may also include inverting the ice cavity 52 relative to the direction of gravity.

It will be appreciated that steps of the foregoing methods 900 and/or 1000 may be repeated, as desired, to form a desired quantity of ice. Moreover, an ice machine 10 may be configured to implement one or more exemplary methods of forming ice and/or various exemplary apparatus as disclosed herein.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. §112(f), unless the element is expressly recited using the phrase "means for." As used herein, the terms "comprises", comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

When language similar to "at least one of A, B, or C" or "at least one of A, B, and D" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. An ice formation apparatus, comprising:

a mold configured with an ice cavity wherein water is freezable into an ice cube;

an ejection apparatus disposed within the ice cavity, the ejection apparatus comprising a compressible material configured to eject the ice cube from the ice cavity responsive to freezing of the water in the ice cavity; and a warming apparatus disposed in thermodynamic communication with the mold.

2. The apparatus of claim 1, wherein the ice cavity is configured with a trapezoidal profile with tapered walls, and wherein a bottom of the ice cavity has a planar cross-sectional area that is less than a planar cross-sectional area of a top of the ice cavity.

3. The apparatus of claim 1, wherein the ejection apparatus further comprises at least one of a spring or an air pocket.

4. The apparatus of claim 1, wherein the ejection apparatus occupies between 6 and 8 percent of a volume of the ice cavity.

5. The apparatus of claim 1, wherein the warming apparatus comprises a second ice formation apparatus in thermodynamic communication with the mold and configured to receive water in preparation for freezing, whereby a frozen ice cube in the ice cavity of the mold may be at least partially melted and ejected from the ice cavity of the mold.

6. An ice formation apparatus, comprising:

a mold configured with an ice cavity wherein water is freezable into an ice cube; and an ejection apparatus disposed within the ice cavity, the ejection apparatus configured to eject the ice cube from the ice cavity responsive to freezing of the water in the ice cavity, wherein the ejection apparatus comprises:

a compressible ejection element configured to exert an ejecting force responsive to compression of the compressible ejection element; and a flexible smoothing element configured to prevent ice from adhering to the compressible ejection element.

7. The apparatus of claim 6, wherein the ejection apparatus further comprises:

a retention element comprising a washer whereby the flexible smoothing element is retained in mechanical communication with the mold.

8. The apparatus of claim 7, wherein the ejection apparatus further comprises:

a shaping element disposed annularly outward of the compressible ejection element, the shaping element configured to shape the ice cube.

9. The apparatus of claim 8, wherein the shaping element comprises a circular washer having an angled face configured to direct forming ice toward contact with the compressive ejection element.

10. The ice formation apparatus of claim 8, wherein the shaping element extends a greater distance into the ice cavity at an annularly outward edge than at an annularly inward edge.

11. A self-demolding ice machine, comprising:

a first ice formation apparatus and a second ice formation apparatus disposed about a common axis of rotation, each ice formation apparatus comprising:

a mold configured with an ice cavity wherein water is frozen into an ice cube; and an ejection apparatus disposed within the ice cavity, whereby the ice cube is ejected from the ice cavity;

a filling apparatus having a water supply alternately conveyable to the first ice formation apparatus and the second ice formation apparatus;

a sensing apparatus configured to sense that water has frozen in at least one of the first ice formation apparatus and the second ice formation apparatus; and an escapement disc comprising a circular member fixed about the common axis of rotation relative to which the first ice formation apparatus and the second ice formation apparatus are rotatable, wherein the filling apparatus is configured to selectably fill the first ice formation apparatus or second ice formation apparatus in response to rotating of the first ice formation apparatus and second ice formation apparatus relative to the escapement disc.

12. The machine of claim 11, wherein the sensing apparatus comprises:

a float valve configured to buoyantly float in water in the mold; and an escapement disc slot disposed partially radially through the escapement disc and configured to receive a shaft of the float valve.

13. The machine of claim 12, wherein the sensing apparatus further comprises a switch connected in mechanical communication with the float valve whereby the position of the float valve may be assessed to ascertain whether the water is liquid or frozen.

14. The machine of claim 11, wherein the second ice formation apparatus is configured to at least partially melt an ice cube disposed in the first ice formation apparatus in response to the filling apparatus conveying water to the second ice formation apparatus.

15. The machine of claim 11, wherein the first ice formation apparatus comprises a plurality of ice cavities.

* * * * *